United States Patent [19]

Gach

[11] Patent Number: 4,807,769

[45] Date of Patent: Feb. 28, 1989

[54] TAMPER INDICATING CLOSURE

[75] Inventor: Peter P. Gach, Evansville, Ind.

[73] Assignee: Sunbeam Plastics Corporation, Evansville, Ind.

[21] Appl. No.: 168,389

[22] Filed: Mar. 15, 1988

[51] Int. Cl.[4] ..... B65D 41/62

[52] U.S. Cl. ..... 215/235; 215/253; 220/258; 222/541

[58] Field of Search ..... 220/258; 215/235, 237, 215/254, 253, 274; 222/541

[56] References Cited

U.S. PATENT DOCUMENTS

| | | | |
|---|---|---|---|
| 2,705,085 | 3/1955 | Glensky | 215/42 |
| 3,269,617 | 8/1966 | Goth | 222/541 |
| 3,419,181 | 12/1968 | Stec | 220/258 |
| 3,459,315 | 8/1969 | LaBarre | 222/541 |
| 3,823,841 | 7/1984 | Lovejoy | 215/39 |
| 4,356,939 | 11/1982 | Fitte | 222/541 |
| 4,440,310 | 4/1984 | Heyn | 220/258 X |
| 4,523,691 | 6/1985 | Larkin | 220/266 |

FOREIGN PATENT DOCUMENTS

| | | | |
|---|---|---|---|
| 521979 | 3/1955 | Italy | 215/253 |
| 2041896 | 9/1980 | United Kingdom | 222/541 |

*Primary Examiner*—Donald F. Norton

*Attorney, Agent, or Firm*—Irvin L. Groh; Alfred L. Patmore, Jr.

[57] ABSTRACT

A tamper indicating closure for a container has a center section provided with a ring which may be pulled to open the container. The pull out center section forms part of an insert which is held in position by a cap base. The insert is interposed between the cap base and the neck of the container so as to form a seal between the cap base and the container. The insert can be formed of a softer more easily torn material than the cap base. The cap base can also serve as a pour nozzle for easy pouring, and also will cooperate with the cap lid to obtain a secured closure of the container once the center section of the insert is removed.

6 Claims, 1 Drawing Sheet

TAMPER INDICATING CLOSURE

BACKGROUND OF THE INVENTION

I. Field of the Invention

The invention pertains to closures for bottles and like containers where it is desired that the closure embody means which would indicate that there has been a tampering with and/or opening of the container. Such closures are particularly useful in dispensing consumable materials to the general public. With tamper indicating arrangements, the purchaser will be put on notice that there has been an opening or an attempted opening of the container before it was purchased.

II. Description of the Prior Art

U.S. Pat. No. 4,320,861 granted to Rieke, et al, on Mar. 23, 1982 shows a container having a cap with a lift up tab. The cap can only be removed to obtain entry to the container by pulling the tab and tearing the cap itself. The tear occurs along lines of reduced thickness in the cap. The cap is held in position by an anchor ring which is crimped around a raised boss on the container.

U.S. Pat. No. 4,207,988 issued June 17, 1980 to Prouty, et al shows an outer closure in the form of a cap which is sealed to a neck on a container in a manner so as to enclose access ports. Scroll lines are provided on the closure together with a ring which can be grasped to tear the closure cap off.

U.S. Pat. No. 3,047,178 granted July, 1962 to Poitris, et al, shows an inner seal cap fitted over the neck of a bottle stopper and an outer tear seal member which is turned in at its lower end beneath the shoulders on the bottle stopper so as to provide a seal which must be torn off before the contents of a bottle on which the seals are fixed together with the stopper can be reached.

U.S. Pat. No. 4,572,397 granted February, 1986 to Hans Arens discloses a tear off cap having a weakened portion which determines a tear off area as well as a rip ring which can be pulled to open the cap. The tear off cap rim rests on the neck of a bottle and a filter is positioned between the tear off cap rim and a base cap or "head piece". The base cap is threaded onto the neck of the bottle using a thread form which permits air flow through the threads then through the filter and into the container whenever fluid is sucked out of the container as in metering a chemical during water treatment.

U.S. Pat. No. 4,682,702 granted July, 1987 to Gach discloses a closure comprising a base cap having a top section forming an orifice. The base cap is designed to fit over a container and seal the latter. The orifice has a bottom section integrally molded with the cap which is in the form of a removable disc. A spiral weakened groove is formed in the disc and defines a tear strip. A pull ring attached to the tear strip is used for removing the disc. A lid attached to the base cap serves to close the orifice.

SUMMARY OF THE INVENTION

The present invention provides a closure having a lid, a base member and an insert. The insert includes a flange portion which rests upon the neck of the container with which it is used and is held in position by the base member. The insert further includes a pull out center disc section which seals the container and provides a tamper indicating means. The pull out disc section is provided with member which can be grasped to cause fracture of the disc center section and its removal and thus opening of the container while the flange portion of the insert remains in place.

The closure further includes a lid which is designed to fit closely upon the base, and the base also has an inner sealing flange which cooperates with the insert flange to form a sealed closure when the disc center section has been removed.

According to one form of the invention, the sealing flange on the lid cooperates with a mating flange provided on the insert.

Further according to the invention, the insert can be made of a different material than that of which the base member is formed. It can, for example, be of a more fragile low density material as compared to the base member. The tear away disc center section can then be soft in comparison to the base and much easier to tear than it would be if the disc were made of the same material as the base. On the other hand, the base can be of a relatively hard material which, if tampered with such as by attempting to pry, will more quickly and readily show signs of such tampering than would a softer material, such as a material that would be used to provide a pull out disc member. This makes a much more satisfactory arrangement then where one piece units are used. If one piece units are used which embody the closure lid, base member and the tear out section, the compromise has to be made between a relatively soft material which can be easily torn out and a material of sufficient density and hardness that it will readily disclose a tampering because it will not have the resiliency of a softer material. A material such as a polypropylene would be desirable to be used on the base member, for example, while the tear out member would preferably be of a low density polyethlyene material. Polypropylene would be difficult to tear whereas low density polyethylene, because of its resiliency, would not disclose tampering along its edges, as would occur if someone were attempting to pry a cap off of a bottle, as readily as would a polypropylene edge.

A further concept of the invention is that of providing a relatively softer more resilient material for the insert and hence its tear out disc section and providing a means for supporting the insert as a separate element upon the container neck which includes the concept of securing this softer material between a harder polypropylene surfaces, for example, the base member and the neck of a container. The result is that not only is the insert held in place, but it provides an adequate seal between the closure base member and the container. In fact, a far better seal is provided than would a polypropylene closure itself. Furthermore, by using the relatively soft, easily torn insert for a seal, a better seal is provided and it is not necessary to provide a entirely separate additional member as a seal.

Furthermore, according to one concept of the invention the relatively soft insert can be designed to provide a dispensing orifice which can cooperate with a mating sealing flange on the lid to provide a more satisfactory sealing closure between the lid and the bottle once the tear out disc has been removed. This is important as the material within the bottle is withdrawn from time to time and the lid is closed for storage purposes. The soft relatively resilient lid material, as contrasted to that material of which the base might be formed, will provide a better seal for the lid flange.

These and other advantages will become more apparent from the following description and the accompany drawings:

DETAILED DESCRIPTION OF THE PREFERRED EMBODIMENT OF THE INVENTION

Figure 1:
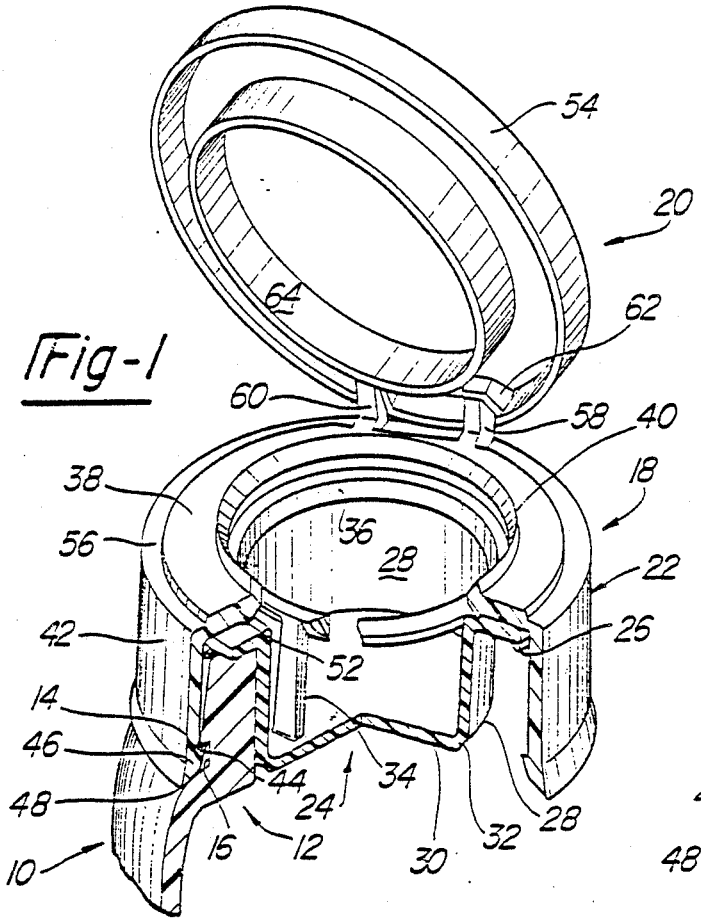
FIG. 1 is a fragmentary perspective view showing a tamper indicating closure according to the invention in position on a container.
Figure 2:
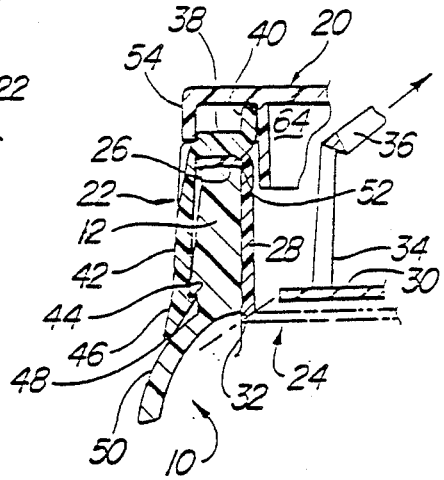
FIG. 2 is a fragmentary sectional elevation of the closure shown in FIG. 1.

Referring now to FIGS. 1 and 2: container 10 is seen to have a neck 12 and is designed to contain medicines or other materials for which it is desirable to provide closures that will indicate when there has been a tampering or actual entering of the container. For this purpose, the neck has an outwardly projecting flange 14 which forms a recess 16 extending around the periphery of the container. A three piece closure 18 consisting of the lid 20, the base 22 and the insert 24 is secured to the bottle. The insert 24 comprises an upper flange 26 which is generally horizontally disposed as shown in the drawings, a depending skirt 28 and a bottom closure portion forming a base 30. Base 30 forms the break out or tear out center disc section of the closure. The flange 26 lies upon the upper lip of the neck 12 of the container, whereas the skirt extends downwardly the full length of the neck 12. The center disc section or base 30 of the insert 24 connects to the depending skirt 28 along a weakened section 32. The skirt 28 extends circumferentially around the inner face of the neck 12 and the weakened section 32, the tear line, likewise extends completely around the lower edge of the depending skirt 28. A post 34 projects upwardly from the base 30 and at its upper end is provided with a pull ring 36 which fits within the skirt 28 but projects upwardly from the base 30 sufficiently to be easily grasped. In order to break the bond between the center disc section 30 and the skirt 28 tension is applied to the post through the ring 36 and thus to the weakened section 32.

Cap base 22 comprises a horizontally extending section 38, and a flange 40 which serves as a pouring spout or nozzle which extends upwardly therefrom approximately parallel to the skirt 28. In addition, the base 22 has a depending skirt 42 forming its lower end. The skirt 42 has an inwardly extending ring like flange 44 which fits within the recess 16 and in fact frictionally engages the downwardly depending ring like planar face of recess 16. Flange 44 and the ring-like surface extend completely around the container.

The skirt 42 continues below the recess 16, terminating in a thin pointed rim like skirt section 46 which tapers to a pointed end 48 and bears firmly against the crown 50 of container 10.

Depending from the horizontally extending section 38 of base 22, there is a circular projection 52. Base 22 is dimensioned such that the fit between flange 44 and container neck recess 16 and between horizontal base section 38, insert flange 26 and container neck 12, and between pointed end 48 and container crown 50 is an interference fit. That is, it is a fit in which the elements are in tension and compression, respectively, resulting a sealed fitting between the elements and particularly between the section 38 and neck 12. As shown particularly in FIG. 2, the depending ring like projection 52, is forced downwardly into the flange 26 forcing the latter into a sealing association with both the section 38 and the neck 12. Thus the insert flange 26 forms a seal.

Lid 20 comprises an outer rim 54 which frictionally engages base 22 in a peripherial recess 56 formed in base 22. The lid is pivotally supported upon the base by means of a pair of posts 58 and 60 which hingedly connect with channels 62. It is known to supply posts such as 60 and 58 with abutments which snap into recesses in the channels in a known manner to provide the necessary hinge connections. See for example U.S. Pat. No. 4,682,702 described above. However, any other form of hinge may be used including a living hinge in which the base, the lid and the hinge are integrally molded. The lid 20 has an inner depending flange or rim 64 which extends downwardly within the circular flange 40 of base 22. A close fit between rim 64 and flange 40 is provided to insure a leak proof association when the lid is closed.

In a preferred form, the insert 24 is formed of a relatively thin, flexible and easily torn material as compared to the base 22 and lid 20. For example, the insert can be formed of low density polyethylene and the base 22 can be formed of polypropolyene. As a result, in the form shown, the insert flange 26 is easily compressed by the base flange 38 to form an appropriate seal for assisting in maintaining the integrity of the contents within the container. In addition, the pointed section 48 of the relatively stiff, inflexible base 22 can, as known in the art, be force fitted onto the container. The parts are dimensioned such that the relatively frangible insert cannot be removed without damaging it. Likewise, the cap base 22 can be removed only be damaging it considerably. For example, if one were to attempt to pry the cap base 22 upwardly through use of a tool inserted beneath the pointed end 48, the relatively stiff inflexible material of which it is made would simply immediately bear markings from the tool, such as a screw driver or pry of any other kind, which might be employed. The same would occur if one attempted to pry the upper flange 38 loose. There would be damage both to it as well as to the very thin relatively soft insert 24.

Figure 3:
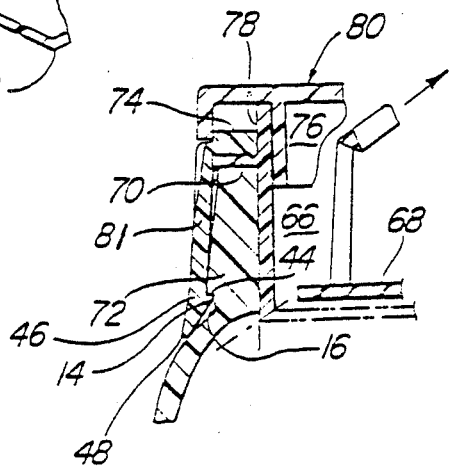
FIG. 3 is a fragmentary sectional elevation of a second form of the invention.

In FIG. 3, yet another form of the invention is shown. In this instance, the skirt 66 of the insert 68 extends upwardly at 78 beyond the horizontal flange 70 overlying the container neck 72. In addition, the base cap spout or flange 40 has been deleted and the horizontally extending base section 74 terminates at the upwardly extending skirt portion 78 which forms a pouring spout. The lid rim 76 in this instance comes into contact with the flange like insert skirt 66 and particularly the upper spout section 78. The elements are dimensioned so as to provide a close fit between the lid 80 and the relatively soft and resilient material of the insert. The result is a improved sealing of the lid whenever the bottle is closed. The dimensions of the base cap skirt 81 and the horizontal section 74 as well as the insert flange 70 are otherwise the same as in the first form described above resulting in an impingement of the base cap section 74 into the insert flange 70 and a sealing connection of the insert flange 70 to both the neck 72 and the base cap section 74.

Figure 4:
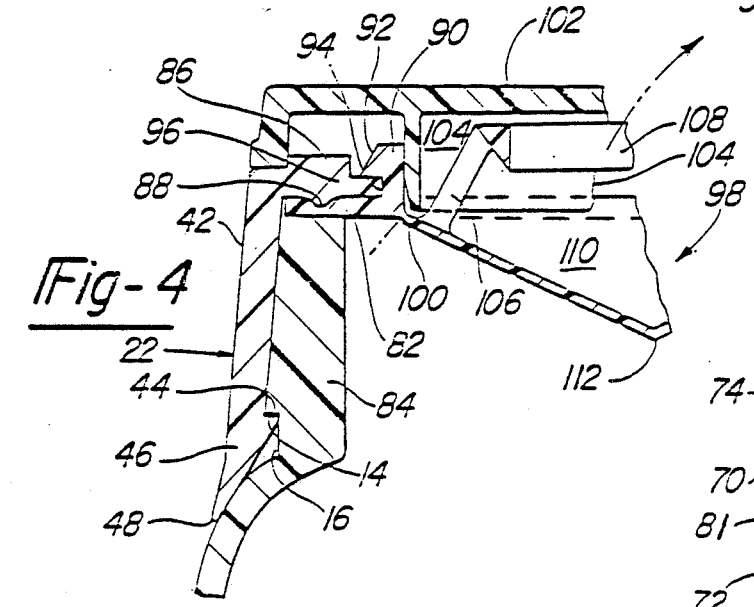
FIG. 4 is a fragmentary sectional elevation of yet another form of the invention.

In FIG. 4 there is shown yet another form of the invention. In this instance, the insert flange 82 projects over the neck 84 of the container, and a base flange like section 86 is provided with the depending projection 88 which extends around the rim of the neck 84 and which is forced into the relativley soft flange 82 by the nature of the geometry of the components as described above with respect to the form of the invention as shown in FIG. 3. In addition, the insert flange 82 projects inwardly of the neck 84 which it is provided with an upstanding circular rim or spout 90. A portion 92 of the upper part of the rim 90 extends outwardly radially from the rim and is spaced vertically from the flange 82 to form a circumferential groove 94. An inwardly extending leg 96 of base flange section 86 is received within the groove 94. Flange leg 96 supports the circumferential insert rim section 90 and limits it outward movement. At the lower inner end of insert flange 82, there is provided a tamper indicating barrier section 98. The latter as in the other forms described above is formed integrally with the flange section 82 and the rim 90 and is connected thereto through a reduced weakened rim like groove 100 extending circumferentially around the insert. The lid 102 in this instance has a depending inner rim 104 which frictionally engages the upstanding rim 90 to form a sealed closure with the latter rim, with the resilient rim section 90 being supported for this purpose by the inwardly projecting section 96. The post 106 extends upwardly at an acute angle with respect to the horizontal and at its end supports the pull ring 108. The angularity of the ring enables positioning of both the support and the ring within the cap when the latter is closed. In addition in this form the tear out section 98 is of a conical shape 110 with the apex 112 positioned beneath the flange 82. The downwardly extending slope of the tear out section gives further room for mounting the post 106 and pull out ring 108.

The three piece construction discloses provided for ease of manufacturing as well as the advantages to be obtained from the ability to choose separate materials for the separate elements and design them for their independent purposes. In addition the shaping of the parts is less limited than it would be if it were necessary for example to form the base 22 and the insert 24 in one piece. More suitable configurations can be provided to achieve better results and yet the cost of molding instead of being increased can be reduced by the ability to utilize the separable elements and later combine them. Both the molds and the molding process can be simplified. Furthermore, the final assembly is not complicated unduly. As will be apparent from the above description and the accompanying drawings the elements can be easily assembled onto a bottle neck. The elements can be in fact pre-assembled and then placed upon the bottle neck. The disc members are held in place within the cap before assembly with a container by friction, with or without the use of an inwardly projecting bead on the base skirt as is known in the art.

While I have shown and described a preferred form or my invention it will be understood that many changes in details and forms may be achieved within the scope of the invention as set forth in the appended claims.

The embodiments of the invention in which an exclusive property or privilege is claimed are defined as follows:

1. A tamper indicating closure for use in both sealing of and dispensing from a container adapted to receive said closure, said closure comprising:

a base member having a skirt for attachment to a container, an upper section extending inwardly of said skirt, and a spout, a lid having container opening and closing positions, said lid having a member which sealingly engages said spout when said lid is in a container closing position, an insert comprising a break out section for opening said container and indicating tampering, said insert comprising a flange extending peripherally thereof and complimentarily formed with respect to said upper base section, and means on said upper base section for impinging on said flange and urging sealing contact between said flange, said upper base section and a neck of a container with which said closure is adapted for use to sealingly close said container and provide tamper indicating means therefore.

2. The closure of claim 1 wherein one of said base member and said insert is formed of a low density polyethylene and the other of said base member and said insert is formed of polypropylene.

3. The closure of claim 1 including said insert being formed of a resilient relatively soft material as compared to the material of said base member flange.

4. The tamper indicating means of claim 1 wherein said base member and said disc member are of a size and configuration such that said insert flange will be compressed between said base member and a container with which said members are designed to be used.

5. The tamper indicating closure of claim 2 wherein said insert flange is formed of a relatively soft resilient material as compared to said base member and forms a gasket like seal when so compressed.

6. The tamper indicating closure of claim 1 wherein said insert comprises a depending skirt with a break out section extending inwardly from said skirt and means connected to said break out portion for applying force to effect tearing thereof from said skirt.

* * * * *